US005457933A

United States Patent [19]

LaVars et al.

[11] Patent Number: 5,457,933

[45] Date of Patent: Oct. 17, 1995

[54] APPARATUS FOR TUCKING FRUIT INTO ORDERED ARRAYS WITHIN PACKING CARTONS

[75] Inventors: Everett LaVars, Pomona; Henry A. Affeldt, Victorville, both of Calif.

[73] Assignee: Sunkist Growers, Inc., Ontario, Calif.

[21] Appl. No.: 201,513

[22] Filed: Feb. 24, 1994

[51] Int. Cl.[6] ..... B65B 3/04; B65B 39/00

[52] U.S. Cl. ..... 53/247; 53/448; 53/475; 53/255; 53/261

[58] Field of Search ..... 53/448, 475, 537, 53/538, 261, 247, 543, 262, 260, 439, 530, 255

[56] References Cited

U.S. PATENT DOCUMENTS

| | | | |
|---|---|---|---|
| 3,453,802 | 7/1969 | Riddington | 53/247 |
| 3,590,551 | 7/1971 | Riddington | 53/538 |
| 3,609,938 | 10/1971 | Paddock | 53/247 |
| 3,928,942 | 12/1975 | Paddock et al. | 53/247 |
| 4,386,491 | 6/1983 | Cramer et al. | 53/247 |
| 5,117,611 | 6/1992 | Heck et al. | 53/475 |

*Primary Examiner*—Lowell A. Larson
*Assistant Examiner*—Rodney Butler

[57] ABSTRACT

An improved actuating system for a plurality of tucker plates used to compress and tuck arrays of fruit placed by an automated fruit handler into shipping cartons is described. The timing and motive force used for operation of the tucker plate is derived from motion of the fruit handler. Contact of the fruit and the fruit handler with an inclined tucker plate on each of four side is sufficient to cause tucker plates to rotate about a hinge assembly which couples the tucker plate to the packer table through which the fruit handler disposes the layers of fruit into the shipping cartons positioned on a conveyor underneath the packer table. Each tucker plate is provided with an upper finger which contacts the fruit handler as the fruit handler move upwardly thereby causing a torque to be applied to the tucker plate to reorient the tucker plate from the vertical packing position to an open tilted receiving position.

14 Claims, 4 Drawing Sheets

APPARATUS FOR TUCKING FRUIT INTO ORDERED ARRAYS WITHIN PACKING CARTONS

BACKGROUND OF THE INVENTION

1. Field of the Invention

The invention relates to the field of apparatus for packing fruit into shipping cartons, and in particular to a mechanism for operating plates used for guiding the fruit into the carton within a carton packing machine.

2. Description of the Prior Art

Storage, handling, shipping costs and presentation of fruit quality are optimized if fruit is graded by size so that fruit having approximately the same size is compactly stored in ordered arrays within the cardboard shipping cartons. The number of fruit as well as the security of the fruit within the shipping carton is increased by packing in a dense array. For example, it is well known to pack fruit, such as citrus fruit, into rectangular cartons in what may be considered a body-centered cubic lattice array. The cubic nature of the array allows the fruit to completely fill the rectangular cardboard carton. The body-centered arrangement allows the density of fruit to be increased as well as the security of positioning of the fruit within the carton so that the fruit position is unlikely to shift as the box is moved. A body-centered array is defined as being constructed of unit cubes having an item of fruit at each of the eight corners of the cube with a ninth item of fruit positioned at the center of the cube. Each item of fruit touches the adjacent fruit. Alternatively, the structure may be visualized as having a layer of fruit laid down in a rectangular array with a second layer of fruit laid thereover which is offset from the underlying layer, so that each fruit in the overlying layer rests in the interstitial depression defined by four of the fruit in the underlying layer. The next or third layer which is placed over these two layers again is offset so that each item of fruit lies in an interstitial space in the underlying layer. The layers continue to be offset as they are stacked within the carton up to the upper most level of the carton. The carton is thus fully packed with what may be referred to as alternating "A" and "B" layers. Examples of such devices are shown in U.S. Pat. No. 5,117,611.

FIG. 1 shows a citrus fruit packing machine, which incorporates some of the features of the prior art, although the specific machine in FIG. 1 depicts the improvement of the invention. The fruit packer, generally denoted by reference number 10, receives fruit from a sorting conveyor apparatus, not shown, which feeds the fruit to an "A" tray 12 and "B" tray 14. The fruit is supplied from behind packer 10 and is rolled down channels 16 until it meets a stop 18 so that a properly oriented array of fruit is assembled on trays 12 and 14.

An "A" fruit handler 20 and "B" fruit handler 22 then alternately move from the location of its corresponding "A" tray 12 or "B" tray 14 respectively on the left and right positions within packer 10 as depicted in FIG. 1 to a center packing position 24.

A rectangular cardboard carton 26 is carried up by a conveyor underneath packer 10 to center packing position 24. The cardboard carton 26 is a deep rectangular box having a closed bottom, four connected adjacent sides, and flaps leaving the top of box 26 open. The flaps are later folded and sealed. Relevant portions of the open carton are better depicted in FIGS. 5–7. Carton 26 as shown in FIGS. 5–7 remains beneath a table 28 of packer 10.

Each fruit handler 20 and 22 has a plurality of suction fingers 30 provided on their lower surface. Fingers 30 on "A" handler 20 will temporarily affix themselves to the underlying fruit when the "A" handler 20 is lowered onto "A" tray 12 by virtue of vacuum supplied through a manifold to each of fingers 30. Fingers 30 are flexible so that they center themselves on the underlying fruit. One item of fruit is temporarily picked up by each finger 30 by means Of the vacuum supplied to the center of finger 30 which is formed to have a suction cup seal on its end. As fruit handler 20 is lifted, an entire "A" layer is lifted from "A" tray 12. Handler 20 is then moved to center position 24 at which point it descends to positively position or place the fruit within cardboard carton 26. At this time the suction is released, handler 20 pulled upwardly and out of carton 26, leaving the oriented fruit forming a complete packed "A" type layer in position within carton 26.

Similarly, "B" handler 22 picks up a complete layer of fruit from "B" tray 14 in a "B" arrangement through flexible fingers 30 and moves to a loading position 24, as the now empty handler 20 moves to the right in FIG. 1 to pick up a new "A" type layer. Meanwhile, "B" handler 22 moves downwardly into the loading position to place a "B" type layer of fruit on the top of the underlying "A" layer in carton 26. The "B" layer of fruit will be placed in the interstitial regions between the fruit in the "A" layer. Suction is then released on "B" handler 22 which is then moved upwardly and out of cardboard carton 26. "B" handler 22 then moves to the left of FIG. 1 to pick up a new layer as "A" handler 20 moves to the left of FIG. 1 bringing in a new "A" layer. In this way, "A" and "B" layers are alternately placed in carton 26 until filled. Upon being filled after a predetermined number of layers, the carton is moved by the underlying conveyor from packer 10 to be sealed and processed, as an additional carton 26 is then brought into position for filling.

However, as a practical matter, it must be understood that the flexible fingers 30, for various reasons including the fastening on fruit of differing diameters at different points over center, will pick up a layer of fruit which will be splayed outwardly from the edges of handler 20 or 22. The fruit will not be compactly compressed into a minimum rectangular envelope when first picked up. Each fruit will not be in physical contact with each of the adjacent fruit but may, depending upon any number of reasons, be slightly spaced apart from the adjacent fruit. In this splayed condition, it is therefore impossible to place the fruit within the smaller rectangular cross sectional envelope of cardboard carton 26 unless the fruit is first compressed into the desired maximum rectangular envelope.

In the prior art, the compression of the fruit to the maximum rectangular envelope was accomplished by means of four guide plates positioned around the packing opening 32 and packer table 28. These guide plates were pneumatically actuated through electromechanical controls so that the splayed fruit was placed downward within central packing position 24 with the guide plates similarly splayed open to accept the fruit. When handler 20 or 22 was at the right depth, the guide plates were then moved into place by means of pneumatic actuators to compress the fruit within the rectangular outline of the packing carton so that handlers 20 or 22 could be permitted. to continue downwardly to position the fruit within the carton in a dense array. Handlers 20 and 22 then moved upwardly and out of the carton and the guide plates were then driven open by means of the same pneumatic actuators in preparation for accepting the next placement of fruit.

While such pneumatically actuated guide plates worked well, their controls were complex and were subject to breakdown. It is necessary for packer 10 to operate over long periods of time without breakdown, filling hundreds of thousands of cartons quickly and reliably. The pneumatically actuated guide plates were by far the most unreliable part of packer 10 and required constant adjustment and repair.

Therefore, what is needed is some type of actuating mechanism which can be used as part of a guiding mechanism in a packer 10 as used in the prior art, but which is not subject to the problems of complexity, reliability and adjustment which typifies prior art guide plates.

BRIEF SUMMARY OF THE INVENTION

The invention is an improvement to a fruit packer and in particular to the guide plates used for guiding fruit into a packing carton. The fruit is picked up by a pair of fruit handlers from orienting trays which receive the graded and sized fruit. Each fruit handler picks up a layer of fruit to be placed within a rectangular carton. The fruit is nested so that one layer nests into the interstitial space defined by the adjacent layers. The fruit is densely packed within the carton by placement of the fruit in alternating layers into the carton. However, the fruit must be compacted within a maximum rectangular envelope, the envelope of the carton, so that each item of fruit in the rectangular array touches to the greatest extent possible each of the adjacent fruit in order to leave no voids.

Mechanically actuated guide plates, which cooperate with and are mechanically actuated by the movement of the fruit handler, provide a compression or packing function on the four sides of the fruit handler as the fruit handler descends into the packing carton. The guide plates are first oriented in a receiving position. The fruit handler moves downward to a packing opening in a table on which the guide plates are mounted and towards the packing carton underlying the packing opening defined in the table of the packer.

The fruit and/or the fruit handler contacts the guide plates to rotate them downwardly into a packing position. When in the packing position, the guide plates are aligned with or disposed inside the walls of the carton beneath the packing opening and preferably have a lower edge extending into the opening of the empty carton to assist in centering the carton beneath the fruit handler.

The fruit handler continues to moves down while the guide plates are thus substantially vertically aligned with the walls of the packing carton. The fruit is placed in the bottom of the carton. The fruit handler then moves upward. Ultimately, the edges of the fruit handler will contact a finger mounted on or near the upper edge of each guide plate. The continued upward movement of the fruit handler transmits a force through the finger to lift and rotate each guide plate about a pivot hinge which couples the guide plate to the table of the packer.

In the preferred embodiment, the hinge for each guide plate has a bistable configuration. In other words, through the use of an overcenter toggle, the fruit handler moves the guide plate when moving downwardly to a loading position and when moving upwardly through contact with the finger on each plate to an open second bistable receiving position.

The finger on the guide plate itself is pivoted to permit collapse in the downward direction of the fruit handler, but is rigid in the opposite direction to transmit an opening torque to the guide plate when the fruit handler moves upwardly. In this manner, breakage due to possible partial openings of the guide plate is avoided.

As an alternative embodiment, the hinge mechanism which couples each guide plate to the packer table need not provide a bistable configuration, but may be arbitrarily positioned with equal stability in any position by the fruit handler. Springs or mechanisms may be used to balance the guide plate so that any rotational position about its pivot hinge is equally preferred.

More specifically the invention is an improvement in a fruit packer for disposing fruit into a packing carton. The improvement comprises a handler mechanism for handling a plurality of fruit to be disposed in the carton. A guide mechanism guides the plurality of fruit into the carton in a predetermined configuration. The guide mechanism is actuated by physical contact with the handler mechanism. As a result, a reliable, rugged and simplified apparatus is provided for disposing the fruit into the carton.

In the preferred embodiment the carton is four-sided. It has a top side, and is accessed by the handler mechanism through the top side. The handler mechanism assembles the fruit in a four-sided array. The guide mechanism guides each side of the four-sided array of fruit into the four-sided carton within the predetermined configuration.

The carton has a cross-sectional envelope. The guide mechanism has a first and second position. In the first position for receiving the handler mechanism the plurality of fruit is compressed into a two-dimensional cross sectional area conforming with the cross-sectional envelope of the carton. In the second position of the guide mechanism the disposition of the plurality of fruit into the carton after it is compressed is facilitated. The guide mechanism is moved from the first to the second position by the handler mechanism.

The guide mechanism further comprises a toggle mechanism for bistably urging the guide mechanism either into the first or second position.

The guide mechanism further comprises a one-way catch. The one-way catch is arranged and configured to engage the handler mechanism as the handler mechanism is withdrawn from the carton in order to rotate the guide mechanism from the second to the first position while permitting disposition of the handler mechanism into the carton even in the event that the guide mechanism may not be completely disposed in the first position.

The invention is also characterized as an improvement in a fruit packer for packing fruit in a dense array into a carton having sides defining a predetermined cross sectional configuration. The improvement comprises a fruit handler for selectively picking up and then packing a plurality of fruit in predetermined configuration. A plurality of guide plates is disposed proximate to the fruit handler between the fruit handler and the carton. Each of the guide plates has a first and second position. The first position is for receiving the fruit as carried by the fruit handler and for compressing the fruit into the predetermined cross sectional configuration of the carton. The second position is for maintaining compression of the fruit into the predetermined configuration and for facilitating disposition of the fruit by the fruit handler into the carton. The fruit handler contacts the plurality of guide plates to move the guide plates between the first and second position as the fruit handler is moved into and out of the carton. As a result, a highly reliable, simplified and rugged fruit packer is provided.

Even more particularly, the invention is an improvement in a fruit packer having a loading tray and a plurality of fruit handlers. The fruit handlers selectively pick fruit up in a predetermined configuration from the fruit tray and dispose the fruit into a receiving carton positioned beneath a packing table. The fruit handler is automatically moved from the fruit tray to an opening defined within the table and thence downward into the carton where the fruit is released. The fruit handler then is raised upwardly from the carton through the opening and returns to the fruit tray for additional fruit. The improvement comprises a plurality of guide plates rotatably disposed on the table about the opening to receive and compress the fruit carried by the fruit handler as the fruit handler is disposed through the opening into the predetermined configuration defined by the carton. The plurality of guide plates is mechanically actuated to receive and compress the fruit by contact with the fruit handler as the fruit handler moves down and up through the opening. As a result, a simple, reliable and rugged fruit packer is provided.

Each of the guide plates is rotatably coupled to the table in an upwardly inclined configuration to collectively provide a circumferentially narrowing surface leading to the opening so that fruit comes in contact with the guide plates and is compressed by the circumferentially narrowing surface collectively defined by the guide plates to the predetermined configuration defined by the carton.

The plurality of guide plates is further rotatably coupled to the table to subsequently assume a generally vertically inclined configuration so that the plurality of guide plates collectively comprise a circumferential vertical surface to compress and guide the fruit held by the fruit handler in a configuration within a cross sectional configuration defined by the carton. The vertical surface is collectively defined by the plurality of guide plates and is disposed within an opening perimeter of the carton.

Still further the invention can be characterized an improvement in a method for packing fruit in a carton in a predetermined configuration comprising the steps of forming an array of a plurality of fruit with a fruit handler. The array of fruit held by the fruit handler is circumferentially compressed to conform the array of fruit within a predetermined envelope. The fruit is simultaneously disposed into a carton while being circumferentially compressed in the array within a carton. The fruit is circumferentially compressed as a result of the step of disposing the fruit into the carton. As a result, packing of the fruit is simplified while it is still reliably densely packed in the carton.

The step of disposing the fruit into the carton moves the fruit toward the carton. The carton remains fixed in position while the step of circumferentially compressing the fruit into the array within the predetermined envelope is performed by disposing the fruit down an inclined surface along the periphery of the envelope, which inclined surface gives way in time by changing its inclination to the vertical to funnel the fruit into the predetermined configuration within the envelope.

Alternatively, the step of disposing the fruit into the carton moves the carton toward the fruit. The fruit remains fixed in its vertical position while the step of circumferentially compressing the fruit into the array within the predetermined envelope is performed by disposing the carton and an inclined surface along the periphery of the envelope toward the fruit, which inclined surface gives way in time by changing its inclination to the vertical to fit the predetermined configuration of the carton around the fruit.

The invention may be better visualized by now turning to the following drawings wherein like elements are referenced by like numerals.

The invention and its various embodiments may now be better understood by turning to the following detailed description.

DETAILED DESCRIPTION OF THE PREFERRED EMBODIMENTS

An improved actuating system for a plurality of guide plates used to compress and guide arrays of fruit placed by an automated fruit handler into shipping cartons is described. The timing and motive force used for operation of the guide plate is derived from motion of the fruit handler. Contact of the fruit and the fruit handler with an inclined guide plate on each of four sides is sufficient to cause guide plates to rotate about a hinge assembly which couples the guide plate to the packer table through which the fruit handler disposes the layers of fruit into the shipping cartons positioned on a conveyor underneath the packer table. Each guide plate is provided with an upper finger which contacts the fruit handler as the fruit handler move upwardly, thereby causing a torque to be applied to the guide plate to reorient the guide plate from the vertical packing position to an open tilted receiving position.

Figure 1:
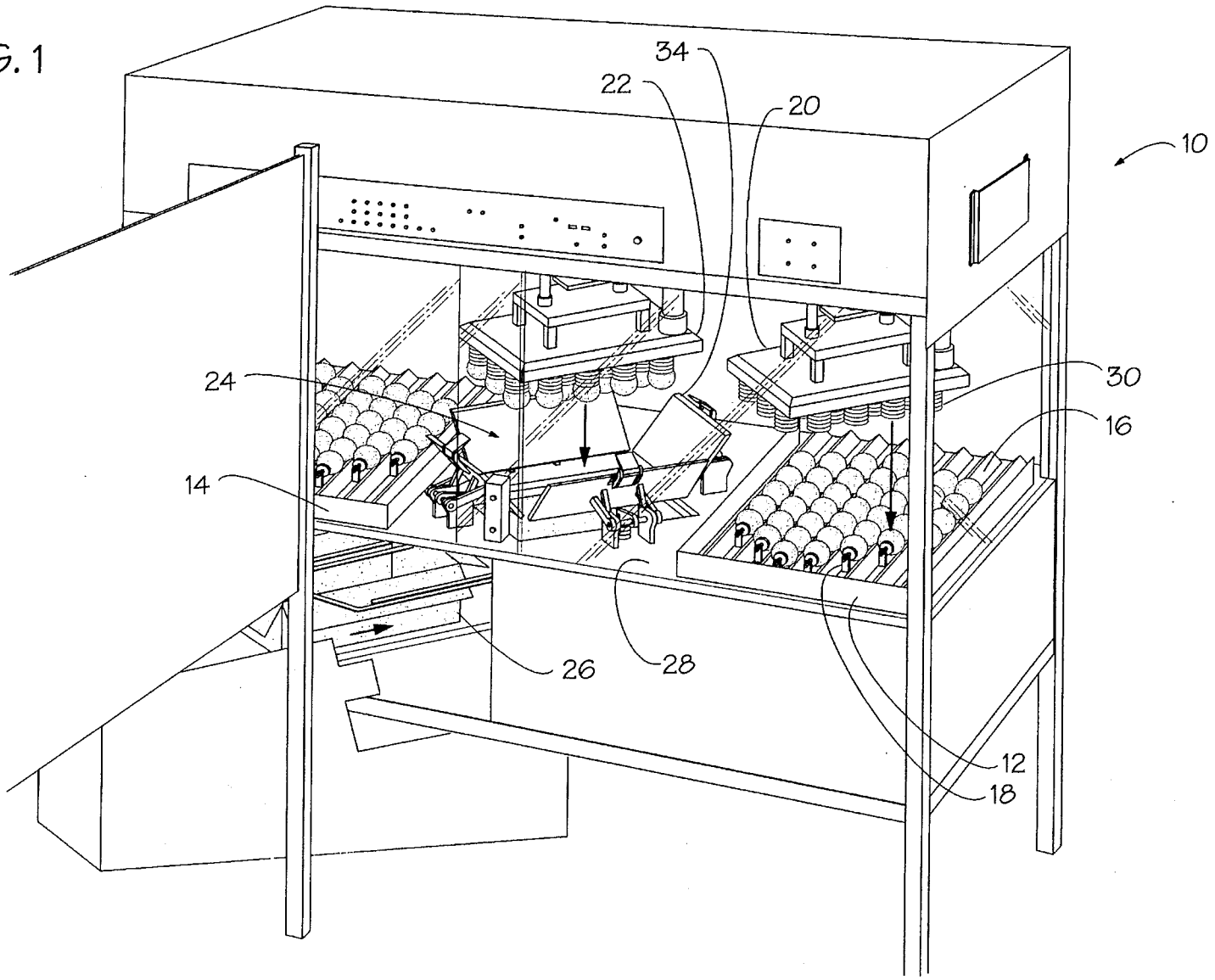
FIG. 1 is a perspective view of a packer showing most of the elements used in the environment of the guide plates, which have been improved according to the invention

Packer 10 is comprised of various elements as described above and utilizes a plurality of guide plates 34 shown in position around the central packing station 24 of FIG. 1. In the illustrated embodiment, four such guide plates 34 are provided and rotatedly splayed into an open or receiving position as better illustrated in FIG. 5 to receive fruit from fruit handlers 20 and 22. Three of the four guide plates are clearly illustrated in the perspective view of FIG. 2, which shows one of the fruit handlers 20 or 22 being moved down in position through the packing opening 32 defined in packer table 28. Each guide plate 34 is coupled through a hinge assembly, generally denoted by reference numeral 36, which is attached to table 28. Each guide plate, together with its hinge 36, operates independently of each of the other corresponding guide plates and hinges 36, although they operate in cooperation through common actuation through fruit handler 20 or 22 as will be described in greater detail in connection with FIGS. 3–7.

Figure 2:
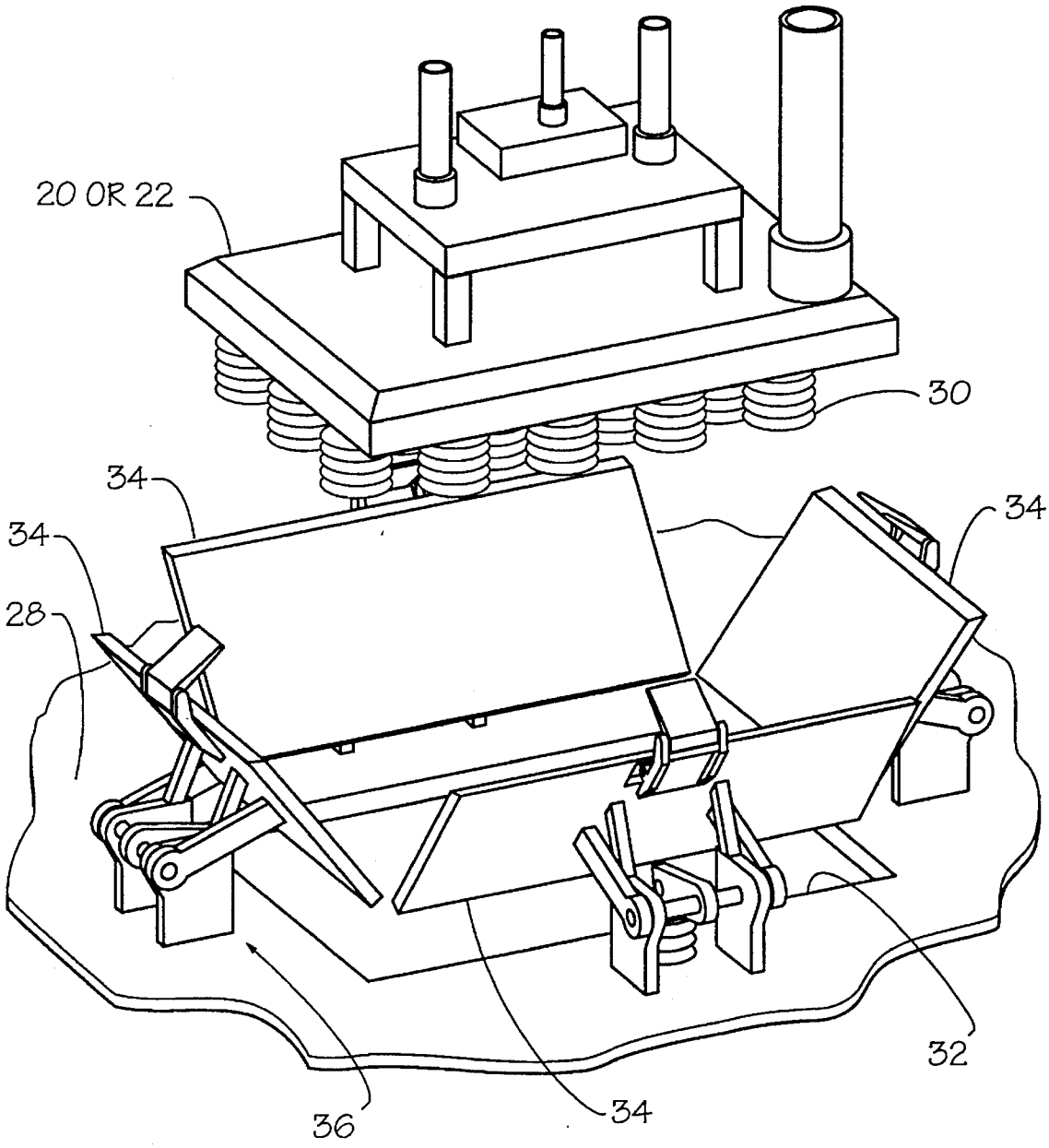
FIG. 2 is a front perspective view of the guide plates of the invention shown in isolation of the remaining portions of the packer of FIG. 1.
Figure 5:
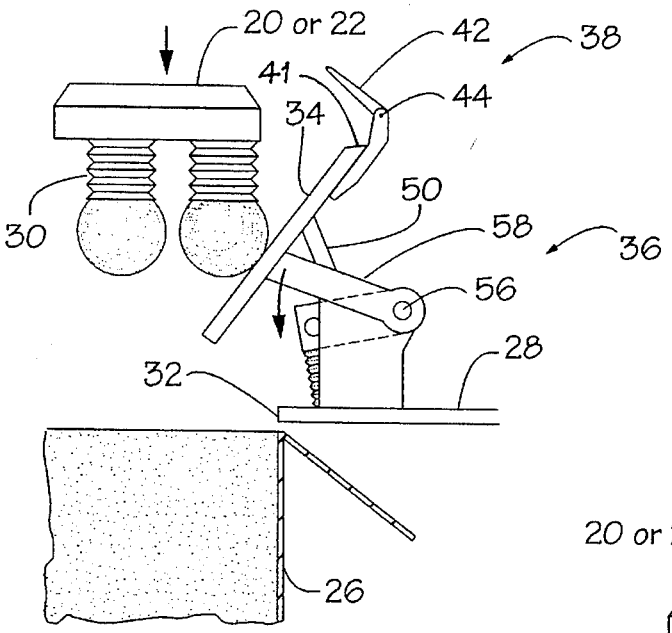
FIG. 5 is a cross sectional side view of the right position of the central packing station of the packer of the invention provided with the improved guide plates, only one of four of which is shown in the view of FIG. 5.

The configuration of guide plates 34 as seen in FIG. 2 is the receiving position shown in cross section view in FIG. 5 in which only one of the four plates is depicted. As seen in FIG. 5, guide plate 34 is splayed upwardly and outwardly to form an inclined surface arranged to contact the splayed fruit as fruit packer 20 or 22 descends downwardly through the packing opening 32 in table 28.

Figure 3:
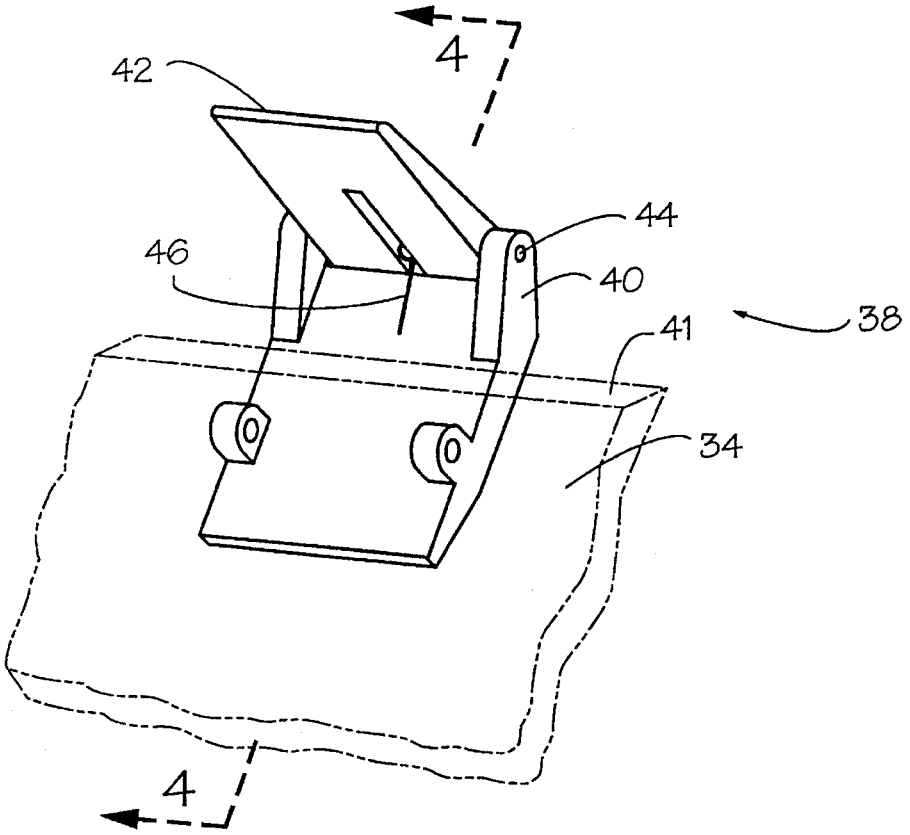
FIG. 3 is a perspective view of the actuating finger as used on the top of the guide plate according to the invention.
Figure 4:
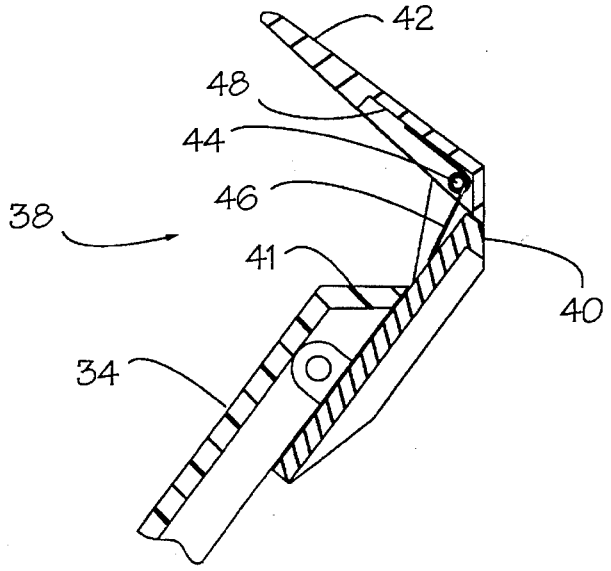
FIG. 4 is a cross sectional view of the actuating finger attached to the guide plate as seen through sectional lines 4—4 of FIG. 3.

Each guide plate 34 is provided with an upper finger 38 fixed to or near its upper edge 41, as better depicted in FIGS. 3 and 4. Each finger 38 in turn is comprised of a body 40 and spring loaded rotatable lever 42 rotatably coupled to body 40 around hinge axis 44. A hairpin spring 46, one leg of which can be seen in FIG. 3 and which is depicted in its entirely in the cross sectional view of FIG. 4, is retained and centered by hinge pin 44 and has a leg bearing against the inside surface 48 of rotatable lever 42 and the inside surface of body 40 which is coupled to the back of guide plate 34.

The spring loaded rotatable coupling of lever 42 to body 40 allows lever 42 to be rotated downwardly if fruit handler 20 or 22 for any reason comes into contact with lever 42. On the other hand, clockwise rotation of lever 42 as seen in FIG. 4 is prevented by the hinge closure or abutment between rotatable lever 42 and body 40 about hinge axis 44. Therefore, as will be described below in connection with FIG. 7, lever 42 will selectively operate to open guide plates 34 when fruit handler 20 or 22 moves upwardly and strikes lever 42.

Figure 6:
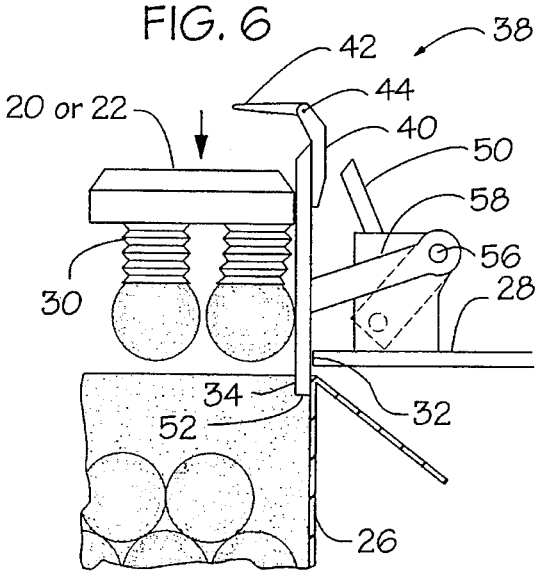
FIG. 6 is the side sectional view of FIG. 5 shown with the guide plate actuated to its guiding position. The illustration of FIG. 5 illustrates the guide plate in the open or receiving position.
Figure 7:
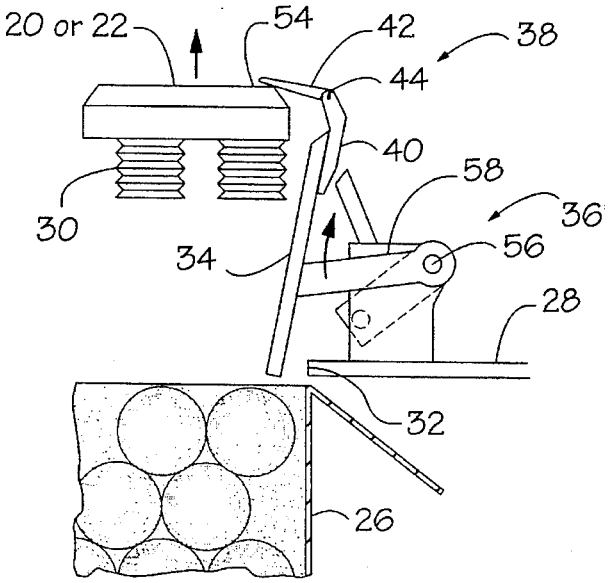
FIG. 7 is a cross sectional view of the guide plate as shown in FIGS. 5 and 6 shown with the guide plates moving from its packing position as shown in FIG. 6 to its receiving position in FIG. 5 as the fruit handler moves upwardly after having released its load of fruit.

Returning to the packing process as shown beginning with the receiving position of FIG. 5, guide plate 34 is inclined against a fixed stop 50 which prevents further clockwise rotation of guide plate 34 in the depiction of FIGS. 5–7. As fruit handler 20 or 22 continues to move downwardly toward opening 32, the fruit will both be compressed by guide plate 34 and guide plate 34 will be rotated downwardly in a counterclockwise sense, as seen in FIGS. 5–7, until it assumes the loading position as shown in FIG. 6. At this point, fruit held by handler 20 or 22 is compressed within the maximum permitted rectangular outline, and guide plate 34 has been rotated so that its lower edge 52 extends through and below opening 32 in table 28 and into the opening of carton 26. In this manner, guide plates 34 also provide a means of centering carton 26 below opening 32 in the event that a misalignment may have occurred as carton 26 is fed into the loading position underneath opening 32.

Hinge assembly 36 is preferably provided with an over-the-center toggle such that it assumes one of two preferred positions. The first preferred position is an open or splayed receiving position of FIG. 5 which is limited by stop 50. The second preferred position is the loading position of FIG. 6 in which further counterclockwise movement of guide plate 34 is prohibited either by carton 26 or opening 32 or both. Details of the toggle spring mechanism used within hinge assembly 36 are conventional and therefore have not been shown in greater detail. Any mechanism well known or later discovered which would serve the same function of preferably positioning guide plate in one of two extreme or limited positions could be utilized.

Alternatively, a bistable hinge mechanism 36 need not be used, but only a mechanism which balances or allows guide plate 34 to assume any one of its positions could be used since the actuation of fruit handler 20 or 22 in combination with guide plate 34 and lever 42 is sufficient alone to move guide plate 34 as required.

The fruit is loaded by fruit handler 20 or 22 which descends to the lowest loading position and releases the fruit as shown in the position of FIG. 6. After the fruit is released, fruit handler 20 or 22 moves upwardly in the unloading position until the upper surface 54 of fruit handler 20 or 22 comes into contact with lever 42. As fruit handler 20 or 22 continues to move upwardly, the upward force transmitted through lever 42, which in the illustrations of FIGS. 5–7 is fixed against clockwise rotation, will pull guide plate 34 upwardly tending to rotate guide plate 34 about its hinged axis 56. The inclination of lever 42, even when in the loading position as shown in FIG. 6, assists in converting the upward movement of fruit packer 20 or 22 into an outward force against plate 34 and places a torque on arm 58 around axis 56.

Ultimately, guide plate 34 will have rotated sufficiently to allow fruit handler 20 or 22 to clear lever 42. The overcenter toggle within hinge assembly 36 will have moved past its center position to its preferred open position of FIG. 5, which will continue the rotation of guide plate 34 into the fully open receiving position of FIG. 5. Even if this were not to occur due to fouling or some other failure within toggle hinge mechanism 36, no damage will occur to the mechanism when the next fruit handler 20 or 22 descends, since lever 42 will rotate out of the way to permit passage of fruit handler 20 or 22 with its load of fruit. Yet, lever 42 will then rotate back into its extended position under the action of hairpin spring 48 to cooperate with fruit handler 20 and 22 to rotate and return guide plate 34 as shown in FIG. 7 to rotate to the guide plates to the receiving position.

Each guide plate 34 is provided with an identical hinge 36 and lever 42 to operate in cooperation with fruit handler 20 or 22 to compress and guide the array of fruit into a centered underlying carton beneath table 28. No exterior hydraulic or electromechanical actuators are required. Rather, the entire device is actuated through a cooperative momentary engagement with the fruit handler 20 or 22, the actual position of which controls the timing and the positioning of guide plates 34. Timing variations are therefore automatically adjusted without the need for complex electromechanical circuitry, and the guide plates operate it without the need for expensive, complex or unreliable hydraulic circuits, actuators and valves.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include what is specifically illustrated and described above, what is conceptionally equivalent, and also what essentially incorporates the germ of the invention.

We claim:

1. An apparatus for disposing fruit into a packing carton comprising:

handler means for handling a plurality of fruit to be disposed in said carton;

guide means for guiding said plurality of fruit into said carton in a predetermined configuration, said guide means being actuated by physical contact with said fruit;

wherein said carton has a cross section, wherein said guide means has a first position for receiving said plurality of fruit as carried by said handler means in order to compress said plurality of fruit into a cross sectional configuration conforming with said cross section of said carton and a second position for facilitating disposition of said fruit into said carton and maintaining said plurality of fruit in said compressed configuration, said handler means moving said guide means from said second to said first position as said handler means is drawn from said carton, and wherein said guide means comprises contact means for directly contacting said handler means when said handler means is drawn from said carton.

2. The improvement of claim 1 wherein said guide means further comprises toggle means for bistably urging said guide means either into said first or second position.

3. The improvement of claim 1 where said tucker means further comprises a one-way catch, said one-way catch being arranged and configured to engage said handler means as said handler means is withdrawn from said carton in order to move said tucker means from said second to said first position while permitting disposition of said handler means into said carton even in the event that said tucker means may not be completely disposed in said first position.

4. An apparatus for disposing fruit into a packing carton, said carton having four sides, including a top side, and a cross-sectional envelope;

handler means for handling a plurality of fruit to be disposed in said carton, said handler means accessing said carton through the top side thereof, and said handler means assembling said fruit into a four-sided array;

guide means for guiding said plurality of fruit into said carton, said guide means guiding each side of said four-sided array into a corresponding interior side of said carton, said guide means having a first and a second position, said first position for receiving said handler means in order to compress said plurality of fruit into a two-dimensional cross-sectional area conforming to said cross-sectional envelope of said carton, and said second position for facilitating disposition of said plurality of fruit into said carton after being compressed, said guide means being moved from said first position toward said second position by direct contact between at least some of said plurality of fruit and said guide means, said handler means moving said guide means from said second to said position as said handler means is drawn from said carton, and wherein said guide means comprises contact means for directly contacting said handler means when said handler means is drawn from said carton.

5. An apparatus for packing fruit in a dense array into a carton having sides defining a predetermined cross sectional configuration, comprising:

a fruit handler for selectively picking up a plurality of fruit in a predetermined configuration;

a plurality of guide plates disposed proximate to said fruit handler between said fruit handler and said carton, each of said guide plates having a first and second position, said first position for receiving said fruit as carried by said fruit handler and for compressing said fruit into said predetermined cross sectional configuration of said carton, said second position for maintaining compression of said fruit into said predetermined configuration and for facilitating disposition of said fruit by said fruit handler into said carton, said fruit contacting said plurality of guide plates between said first and second position as said fruit handler is moved into said carton, said guide plates further comprising contact means for directly contacting said fruit handler as said fruit handler is drawn from said carton.

6. The improvement of claim 5 wherein each of said plurality of guide plates is urged into said first or second position by means of a spring-loaded toggle coupled to said guide plates, said spring-loaded toggle having two preferred configurations, said toggle being actuated between said two preferred configurations by rotation of said guide plate toward said first and second positions respectively.

7. The apparatus of claim 5 wherein said contact means comprises a finger rigidly connected to each of said guide plates, said guide plates being rotated from said second to said first position by contact between said fingers and said fruit handler as said fruit handler is moved away from said carton.

8. The improvement of claim 7 wherein said finger includes an activating arm rotatable in only one direction to permit movement of said fruit handler toward said container without imparting a substantial force through said finger to said guide plate, while assuming a rigid configuration when said fruit handler is moved out of said container so that contact between said fruit handler and said finger imparts a torque to said guide plate to rotate said guide plate from said second to said first position.

9. The apparatus of claim 5 wherein, in said first position, each of said guide plates is oriented in an upwardly inclined configuration to collectively provide a circumferentially narrowing surface leading to said opening so that fruit comes in contact with said guide plates and is compressed by said circumferentially narrowing surface collectively defined by said guide plates to said predetermined configuration defined by said carton.

10. The apparatus of claim 9 wherein, in said second position, said plurality of guide plates is oriented in a generally vertically inclined configuration so that said plurality of guide plates collectively comprise a circumferential vertical surface to compress and guide said fruit held by said fruit handler in a configuration within a cross sectional configuration defined by said carton, said vertical surface collectively defined by said plurality of guide plates being disposed within an opening perimeter of said carton.

11. The apparatus of claim 10 wherein said plurality of guide plates are moved from said first, inwardly inclined, position to said second, vertically inclined position, at least in part, by means of contact of said fruit with that surface of said guide plates inwardly inclined.

12. The apparatus of claim 11 wherein said guide plates are each provided with an inwardly extending finger disposed toward said opening to provide an interfering contact with said fruit handler when said fruit handler is withdrawn from said carton upwardly through said opening, and said plurality of guide plates are moved from said vertically inclined position to said inwardly inclined position by contact between said fruit handler and said inwardly extending finger.

13. The improvement of claim 12 wherein said finger is jointed to permit collapse and passage of said fruit handler as said fruit handler moves downwardly into said opening toward said carton and is rigid to provide rigid interfering contact with said fruit handler as said fruit handler moves upwardly from said carton through said opening.

14. The improvement of claim 13 further comprising a bistable toggle coupled to each of said tucker plates to resiliently urge each of said guide plates preferably either in said inwardly inclined position or in said vertically inclined position.

* * * * *